US005803195A

United States Patent [19]

Haugen et al.

[11] Patent Number: 5,803,195

[45] Date of Patent: Sep. 8, 1998

[54] SYSTEM, METHOD AND CUTTERHEAD FOR DRY FULL-AREA DRILLING

[75] Inventors: Karl Thorbjörn Haugen, Blentarp; Gert Axel Lövgren, Bjärred; Stig-Åke Brolund, Valbo, all of Sweden; Roland Källvik, Råde, Norway

[73] Assignees: Kroll-Disab AB, Lund; Sandvik AB, Sandviken, both of Sweden

[21] Appl. No.: 687,373

[22] PCT Filed: Feb. 1, 1995

[86] PCT No.: PCT/SE95/00092

§ 371 Date: Aug. 26, 1996

§ 102(e) Date: Aug. 26, 1996

[87] PCT Pub. No.: WO96/13649

PCT Pub. Date: May 9, 1996

[30] Foreign Application Priority Data

Feb. 2, 1994 [SE] Sweden ..... 9400324

[51] Int. Cl.[6] ..... E21B 10/28

[52] U.S. Cl. ..... 175/385; 175/391

[58] Field of Search ..... 175/385, 386, 175/391, 392, 213

[56] References Cited

U.S. PATENT DOCUMENTS

| | | | |
|---|---|---|---|
| 3,314,724 | 4/1967 | Tinlin . | |
| 4,275,796 | 6/1981 | Kleine | 175/385 |
| 5,199,515 | 4/1993 | Sinclair et al. | 175/213 |
| 5,417,292 | 5/1995 | Polakoff | 175/391 X |

FOREIGN PATENT DOCUMENTS

| | | |
|---|---|---|
| 3639378 | 11/1979 | Australia . |
| 2414614 | 1/1978 | France . |
| 3445578 | 6/1986 | Germany . |
| WO 81/00590 | 3/1981 | WIPO . |

*Primary Examiner*—William P. Neuder
*Attorney, Agent, or Firm*—Beveridge, DeGrandi, Weilacher & Young, LLP

[57] ABSTRACT

In a method for use in dry, rotary, crushing full-area drilling, use is made of suction air alone for removing cuttings produced during drillings. To carry out the method, two suction nozzles (13) are arranged on the underside of a cutterhead (1). These nozzles together have a substantially diametrical extent and the length of a radius on the cutterhead and are provided with suction intakes (14A) in the vicinity of the periphery of the cutterhead. The suction intakes (14A) are connectible a common suction channel (11) in the drill string (6) of the cutterhead. The suction channel (11) has substantially constant diameter.

35 Claims, 4 Drawing Sheets

SYSTEM, METHOD AND CUTTERHEAD FOR DRY FULL-AREA DRILLING

The present invention relates to a system, a method and a cutterhead for dry full-area drilling according to the preambles of the independent claims.

A downward-drilling system according to the preamble of claim 1 is known from U.S. Pat. No. 5,199,515. This system operates with compressed air which is injected towards the shaft bottom through a hollow drill string and blow nozzles communicating therewith which are arranged on the cutterhead, as well as with suction air operating through suction nozzles arranged on the cutterhead and riser ducts communicating therewith. The riser ducts serve to remove cuttings which are produced by the rotating, crushing cutterhead and which are transported with the aid of the compressed air towards the suction nozzles and through stationary riser pipes to above ground. The nser ducts and the stationary riser pipes are interconnected by a swivel.

This known system has however proved to involve the risk that the cuttings produced swirl up and are sprayed about by the compressed air and that portions of the swirling cuttings are out of the reach of the suction nozzles. As a result, cuttings and dust will impinge on the shaft wall and adhere to it. This entails that the cutterhead will work material that has already been partially worked, resulting in unnecessary wear to the cutterhead and lower cutting efficiency of the system. Moreover, the shaft walls are sometimes soiled to an unacceptable extent, for example in the case of bedrock depository of spent nuclear fuel.

The object of the invention is to overcome or at least essentially reduce the above-described problems inherent in the prior-art drilling system. Also, the invention aims to provide a constructional simplification of the known system.

According to the invention, these objects are achieved by means of a drilling system, a drilling method and a cutterhead according to the description below.

According to the invention, the use of compressed air is thus dispensed with, the cuttings being removed by suction only. To this end, there is provided at least one suction nozzle at the underside of the cutterhead, the suction nozzle or nozzles each having a suction intake at the periphery of the cutterhead, where a relatively larger amount of cuttings is produced by the cutterhead from the shaft being drilled. The suction intake communicates with a suction channel which is provided in a drill string and which is connected to a vacuum unit above ground. If several suction nozzles are used, which is preferred, they are arranged pairwise substantially along diameters of the cutterhead. Preferably, the cutterhead has a pilot drill bit which is provided with additional suction nozzles, also communicating with said suction channel.

The invention has also proved applicable to tunnel drilling.

The invention will now be described in more detail with reference to the accompanying drawings showing an embodiment thereof.

Figure 1:
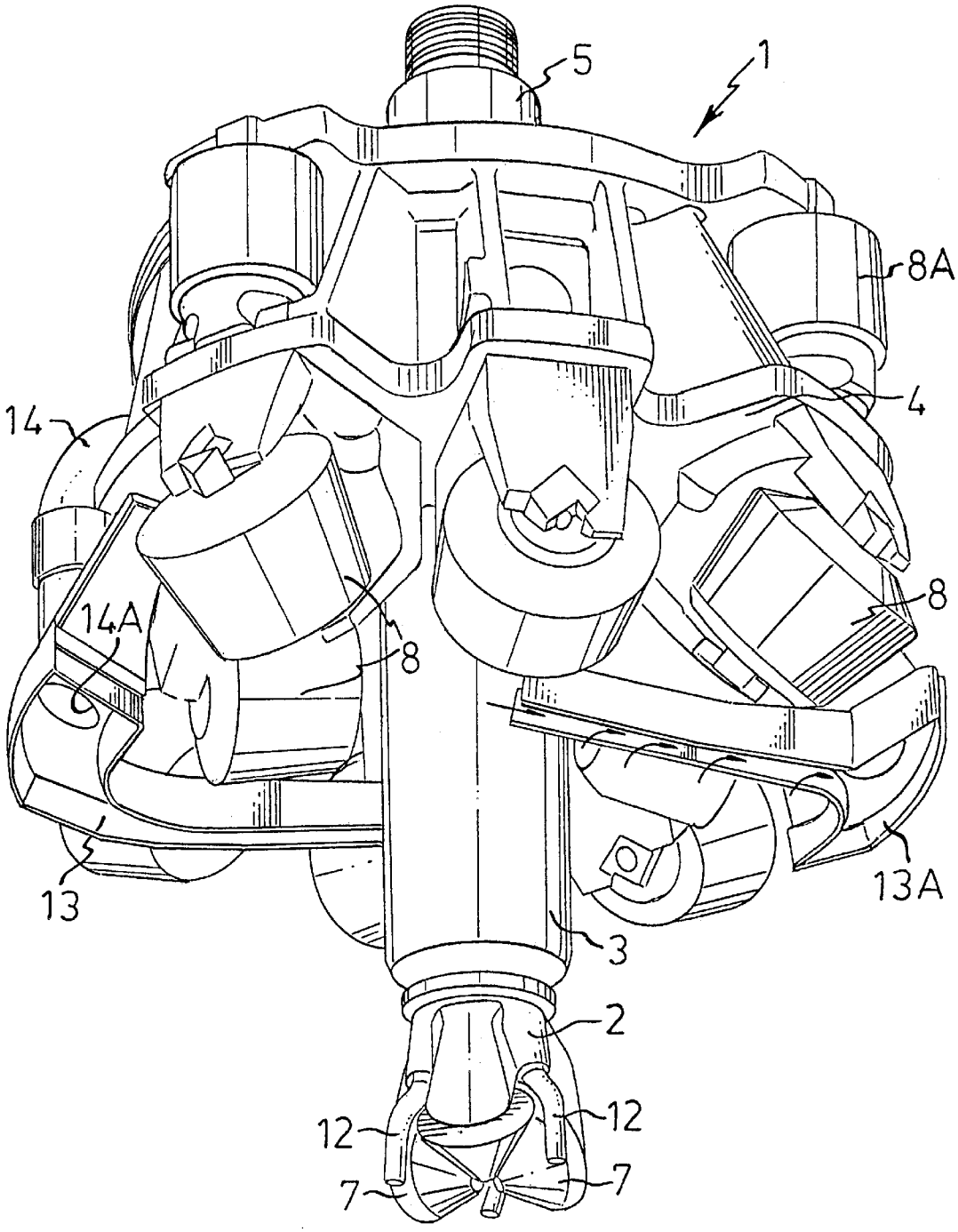
FIG. 1 shows a cutterhead according to the invention in perspective.
Figures 2, 4:
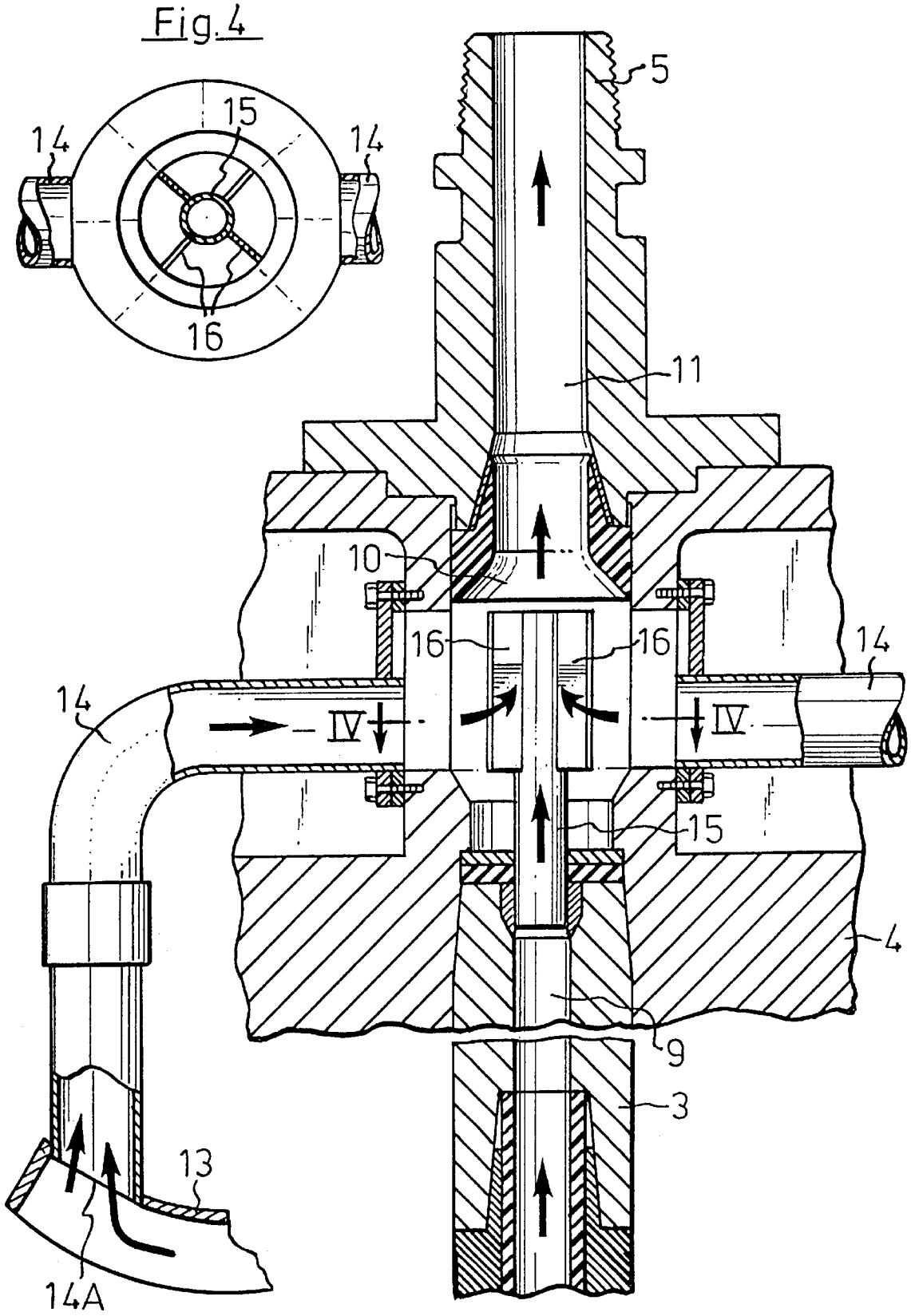
FIG. 2 shows the cutterhead partly in section and partly schematically.
FIG. 4 shows means for guiding the cuttings in a section taken along line IV—IV in FIG. 2.
Figure 3:
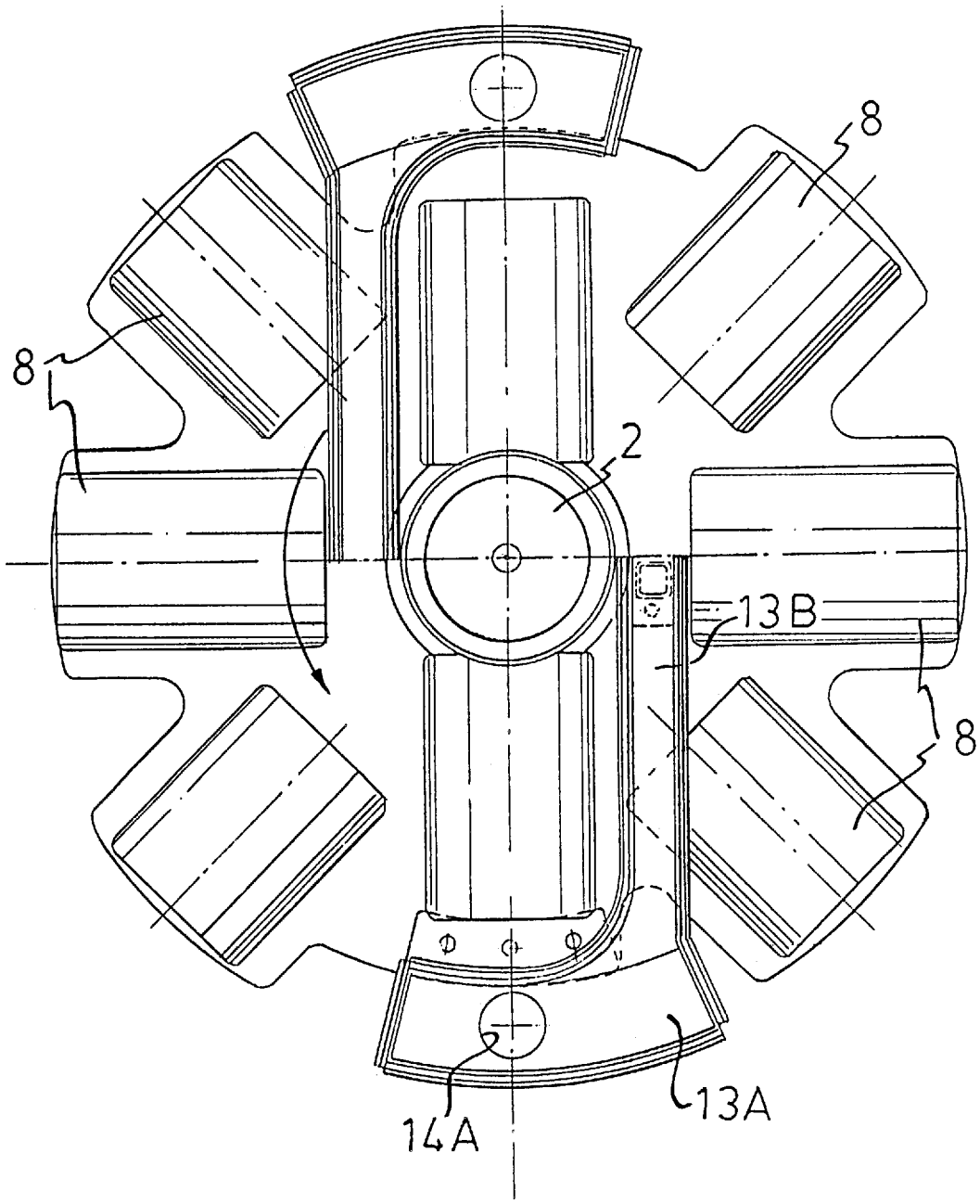
FIG. 3 shows the cutterhead from below.
Figure 5:
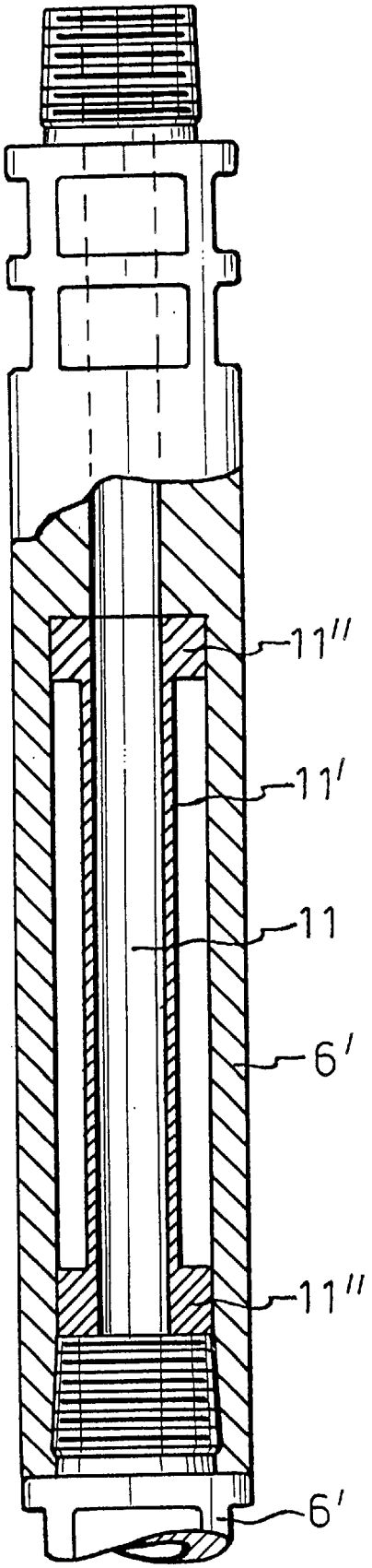
FIG. 5 shows a drill pipe with a suction sleeve.

FIGS. 1–3 show a cutterhead 1 for dry rotary, crushing full-area drilling. The cutterhead has a pilot drill bit 2 on a pilot rod 3, a base head 4 and an adapter 5 for connecting the cutterhead 1 to a drill string 6 (FIG. 5). The roller cutters of the base head 4 and of the pilot drill bit 2 are designated 7 and 8, respectively. The construction described so far is previously known and also comprises stabiliser rollers 8A.

Through the base head 4 and the pilot drill bit 2 extends a suction channel 9 which via a plenum 10 merges into a suction channel 11 arranged in the drill string 6 (FIG. 5). This suction channel is connected to a vacuum unit (not shown) via a separator, such as a cyclone (not shown), for cuttings produced by the cutterhead 1 in the shaft.

At the bottom, the suction channel 9, extending through the cutterhead 1, communicates with three suction nozzles 12 on the pilot drill bit 2. The openings of these suction nozzles are located slightly above the lowermost point of the pilot drill bit roller cutters 7, and the nozzles are evenly distributed between the three roller cutters 7.

At the bottom of the base head 4, there are attached two symmetrically positioned suction nozzles 13 which have the length of a radius on the cutterhead and which are disposed substantially along a diameter and in which the suction generated by the vacuum unit operates. This suction acts on the nozzles through a respective, external pipe 14 (of which only one is visible in FIG. 1) via the plenum 10. Each of these pipes has its opening 14A located in a portion 13A of the respective nozzle 13, which portion 13A extends substantially in the circumferential direction of the base head 4. Thus, the nozzles 13 are L-shaped, the heel of the L facing in a direction contrary to the rotational direction of the cutterhead 1. The foot 13 of the L also is slightly wider, so that also the comparatively larger amount of cuttings produced by the peripheral roller cutters 8 will also be taken care of by the suction generated by the vacuum unit for upward transport.

The substantially radial legs 13B of the suction nozzles 13 extend from the foot 13A to the centre line of the drill bit 4 on each side of the relatively narrow pilot rod 3. During the rotation of the cutterhead 1, the nozzles 13 and the suction nozzles 12 disposed therebetween will thus cover the entire working area by their suction action, so that this area is "vacuum-cleaned" in its entirety without any cuttings or dust being flung against the shaft wall. In this context, it should be noted that the free end of the L-leg 13B is radially open.

It appears from the Figures that the suction nozzles 13 have an inverted U-shaped section and that the nozzles are located close to the lower plane of the base head 4, to which the lowermost roller cutters 8 are tangent. The free edges of the suction nozzles 13 consist of yieldable rubber strips.

Reference is now made to FIG. 4. In the area of the connection of the pipe 14 with the plenum 10, the suction channel 9 is formed of a pipe section 15 on whose outer wall are attached four radial wings 16. They make a 90° angle with each other and guide the cuttings sucked through the pipe 14 towards the plenum 10 while preventing collision between the counterdirected flows of cuttings.

As mentioned above, the suction communication between the nozzles 13 is brought about by means of a suction channel 11 arranged in the drill string 6. The suction channel 11 has the same inner diameter throughout its entire length, the purpose of which is to minimise pressure losses in and wear to the drill string 6, normally having a varying inner diameter, see FIG. 5, illustrating a typical drill pipe 6', the drill string being composed in known manner by several such drill pipes. The suction channel 11 is formed of the upper portions of the drill pipes 6' and of one (or more) sleeves 11' inserted in each drill pipe 6' and having an inner diameter corresponding to the minimum inner diameter of the drill pipe 6' in the upper portion. The sleeves 11' have end flanges 11" abutting on the shoulder portion of the bore of the drill pipe 6' and on the top of the preceding lower drill pipe screwed on. The sleeve 11' is loosely arranged in its drill pipe 6', so that it can be easily replaced, if so required. The above-mentioned inner diameter of the sleeves 11' also agrees with the inner diameter of the swivel connection of the drilling machine (not shown), with the drill string 6.

The term "dry" in "dry full-area drilling" does of course not exclude the suction of liquid that may exist in the drill shaft.

We claim:

1. A system for dry, rotary, crushing full-area drilling, comprising a cutterhead rotatably connected to a hollow drill string and having nozzle means and a suction channel for removing cuttings produced during drilling, by means of air, wherein the nozzle means and suction channel for removing the cuttings are adapted to remove the cuttings by suction, and said nozzle means including one or more underside suction nozzles fixed to the underside of the cutterhead, each underside suction nozzle generally having a diametrical extent and a length of a radius on the cutterhead and each underside suction nozzle being provided with a suction intake in the vicinity of a periphery of the cutterhead and each suction intake communicates with said suction channel which extends along the drill string.

2. A system as claimed in claim 1, characterised in that there are a plurality of said underside suction nozzles arranged in at least one pair, and the underside suction nozzles of said at least one pair generally being located along diameters of the cutterhead.

3. A system as claimed in claim 2, characterised in that each of said one or more underside suction nozzles of the cutterhead is substantially L-shaped to provide a widened nozzle in the area of an associated suction intake.

4. A system as claimed in claim 2, characterised in that the cutterhead has a pilot drill bit and said nozzle means further includes pilot drill bit suction nozzles which are supported by said pilot drill bit and which communicate with said suction channel.

5. A system as claimed in claim 2, characterised in that the underside suction nozzles of said at least one pair are arranged symmetrically with respect to each other.

6. A system as claimed in claim 5, characterised in that each of the underside suction nozzles of the cutterhead is substantially L-shaped to provide a widened nozzle in the area of an associated suction intake.

7. A system as claimed in claim 5, characterised in that the cutterhead (1) has a pilot drill bit (2) with pilot drill bit suction nozzles (12) which also communicate with said suction channel (11).

8. A system as claimed in claim 5, characterised in that the suction channel is formed of sleeves exchangeably inserted in the drill string.

9. A system as claimed in claim 1, characterised in that each of said one or more underside suction nozzles of the cutterhead is substantially L-shaped to provide a widened nozzle in the area of an associated suction intake.

10. A system as claimed in claim 9, characterised in that the cutterhead (1) has a pilot drill bit (2) with pilot drill bit suction nozzles (12) which also communicate with said suction channel (11).

11. A system as claimed in claim 9, characterised in that the suction channel is formed of sleeves exchangeably inserted in the drill string.

12. A system as claimed in claim 1, characterised in that the cutterhead has a pilot drill bit and said nozzle means further comprises a pilot drill bit suction nozzle which is supported by said pilot drill bit and which also communicates with said suction channel.

13. A system as claimed in claim 12, characterised in that the suction channel is formed of sleeves exchangeably inserted in the drill string.

14. A system as claimed in claim 1, characterised in that the suction channel is formed of sleeves exchangeably inserted within the drill string.

15. A system as recited in claim 1, wherein said one or more underside suction nozzles have an inverted U-shaped cross-section.

16. A system as recited in claim 1, wherein said underside suction nozzles are L-shaped with a peripheral foot and a substantially radial extension that has an inverted U-shaped cross-section.

17. A system as recited in claim 16, wherein the substantially radial extension of each underside suction nozzle extends from the peripheral foot to a center line of the cutterhead to each side of a pilot rod of the cutterhead.

18. A system as recited in claim 1, further comprising a hollow drill string formed of a plurality of hollow drill string components and wherein said suction channel has a constant diameter for an entire length of said hollow drill string.

19. A system as claimed in claim 18, characterised in that the suction channel extends in the drill string and is formed of sleeves exchangeably inserted therein.

20. A system as claimed in claim 1, wherein said one or more underside suction nozzles extend along the undersurface of said cutterhead and open out away from the undersurface of said cutterhead.

21. A system as recited in claim 1, wherein said one or more underside suction nozzles extend along the undersurface of said cutterhead in a generally radial fashion whereby each nozzle extends along a line that is parallel with the undersurface of said cutterhead.

22. A method for dry, rotary, crushing full-area drilling with a cutterhead, including using suction air alone for removing cuttings produced during drilling, the suction air being sucked in through nozzles of generally diametrical extent which are supported on the undersurface of the cutterhead and which are provided with suction intakes in a periphery of a base head of the cutterhead.

23. A method as claimed in claim 22, characterised by conducting the suction air both through the base head and through a pilot drill bit on the cutterhead and out of a drill shaft joined with said cutterhead.

24. A method as claimed in claim 23, characterised by conducting the suction air from the nozzles to the drill string of the cutterhead.

25. A method as claimed in claim 22, characterised by conducting the suction air from the nozzles to the drill string of the cutterhead.

26. A method as recited in claim 22, wherein the suction air is sucked through suction nozzles that have an inverted U-shaped cross-section.

27. A method as recited in claim 22, wherein the suction air is sucked through nozzles that are L-shaped with a peripheral foot and a substantially radial extension that has an inverted U-shaped cross-section.

28. A method as recited in claim 27, wherein the substantially radial extension of each nozzle extends from the peripheral foot to a center line of the cutterhead to each side of a pilot rod of the cutterhead.

29. A cutterhead for use in dry, rotary, crushing full-area drilling, comprising one or more cutterhead suction nozzles fixed to the underside of the cutterhead and each cutterhead suction nozzle generally having a diametrical extent and the length of a radius on the cutterheads and said one or more cutterhead suction nozzles including one or more suction intakes in the vicinity of a periphery of the cutterhead, said one or more suction intakes being associated with one or more suction ducts (14) of the cutterhead which one or more suction ducts open directly into a connecting element (5) of the cutterhead which connects said cutterhead to a drill string.

30. A cutterhead as claimed in claim 29, characterised in that a pilot drill bit air nozzle is provided on a pilot drill bit extending from a base head of the cutterhead.

31. A cutterhead as recited in claim 30, wherein there is at least one opposing pair of said cutterhead suction nozzles each having a radial leg extending to a central area of said cutterhead and to opposite sides of said pilot drill.

32. A cutterhead as recited in claim 29, wherein said one or more cutterhead suction nozzles have an inverted U-shaped cross-section.

33. A system for dry, rotary, crushing, full area drilling, comprising:

a drill string;

a cutterhead connected to said drill string;

a first cutterhead suction nozzle positioned on an underside of said cutterhead, said first cutterhead suction nozzle being disposed generally along a diameter of the underside of the cutterhead, and said cutterhead suction nozzle extending along the undersurface of said cutterhead for a length of a radius of the cutterhead, and said first underside suction nozzle having a suction intake in a vicinity of a peripheral edge of said cutterhead, and the suction intake of said first underside suction nozzle communicating with a suction channel which extends along said drill string.

34. A system as recited in claim 33, further comprising a second cutterhead suction nozzle disposed generally along a diameter of the undersurface of the cutterhead, and said second cutterhead suction nozzle extending for a radius of the cutterhead along a substantially common diameter with respect to said first cutterhead suction nozzle, and said second cutterhead suction nozzle having a suction intake in a vicinity of the peripheral edge of said cutterhead, and said second cutterhead suction nozzle communicating with the suction channel in said drill string.

35. A system as recited in claim 33, further comprising a pilot drill bit extending off from the underside of said cutterhead and said suction channel extending along said pilot drill bit through said cutterhead and along said drill string, and said cutterhead supporting a conduit that opens into said suction channel at one end and is in communication with the suction intake of said first underside suction nozzle, and said pilot drill bit including one or more pilot drill bit suction nozzles opening into said suction channel.

* * * * *